US005233715A

United States Patent [19]

Huang

[11] Patent Number: 5,233,715

[45] Date of Patent: Aug. 10, 1993

[54] COMBINATION TOOL ASSEMBLY FOR GRAPHIC ART

[76] Inventor: Ming-Tzung Huang, No. 122, Sec. 3, Kang Ning Road, Na Fu, Taipei, Taiwan

[21] Appl. No.: 980,876

[22] Filed: Nov. 24, 1992

[51] Int. Cl.[5] ..... B25F 1/04

[52] U.S. Cl. ..... 7/164; 7/163; 7/160; 7/168; 7/170; 33/485

[58] Field of Search ..... 7/164, 163, 158, 167, 7/168, 170, 160; 33/485, 491, 709

[56] References Cited

U.S. PATENT DOCUMENTS

| | | | |
|---|---|---|---|
| 14,306 | 2/1856 | Cross | 7/167 |
| 95,964 | 10/1869 | Zerbe | 33/491 |
| 105,210 | 7/1870 | Horton | 7/164 |
| 469,593 | 2/1892 | Patterson | 33/485 |
| 642,498 | 1/1900 | Smith | 33/485 |
| 1,275,364 | 8/1918 | Bassisty | 7/167 |
| 1,488,875 | 4/1924 | Franklin et al. | 7/164 |
| 1,571,115 | 1/1926 | Gootherts | 7/164 |

FOREIGN PATENT DOCUMENTS

| | | | |
|---|---|---|---|
| 2640550 | 6/1990 | France | 33/485 |

*Primary Examiner*—Roscoe V. Parker
*Attorney, Agent, or Firm*—Lowe, Price, LeBlanc & Becker

[57] ABSTRACT

A combination tool assembly is disclosed having a pentagonal top block detachably fastened to an elongated, pentagonal base through doweled joints, a folding rule pivoted to the top block and received in a side chamber on the base, a cutter and ballpoint pens controlled by slides to move in and out of respective holes on the base, a triangular scale detachably side matched to the top block and the base. The folding rule may be separately used for measuring and arranged with the base into an instrument for drawing circles.

3 Claims, 3 Drawing Sheets

COMBINATION TOOL ASSEMBLY FOR GRAPHIC ART

BACKGROUND OF THE INVENTION

The present invention relates to a combination tool assembly for graphic art which combines a triangular scale, a cutter, a folding rule and pens into a compact set.

Various writing materials may be used in graphic art. In the interest of keeping a variety of writing materials in order, a variety of stationery boxes and cases have been proposed, and have appeared on the market. However, it is still not convenient to carry several writing materials with one self by a stationery box or the like. There is proposed a combination instrument which combines a rule and a compass together. This combination instrument provides two functions and minimizes the storage space.

SUMMARY OF THE INVENTION

The present invention has been accomplished under the aforesaid circumstances. According to one aspect of the present invention, the combination tool assembly is comprised of a pentagonal top block detachably fastened to an elongated, pentagonal base to hold a rule, a triangular scale, a cutter and pens. According to another aspect of the present invention, the elongated, pentagonal base has chambers and holes to receive the rule, cutter and pens on the inside, so that the size of the combination tool assembly is minimized. According to still another aspect of the present invention, the folding rule can be arranged with the elongated, pentagonal base and formed into an instrument for drawing circles of different diameter. According to still another aspect of the present invention, the triangular scale is detachably side matched to the pentagonal top block and the elongated, pentagonal base, and can be used as a proportional scale as well as an instrument for angle measure.

DETAILED DESCRIPTION OF THE PREFERRED EMBODIMENT

Figure 1:
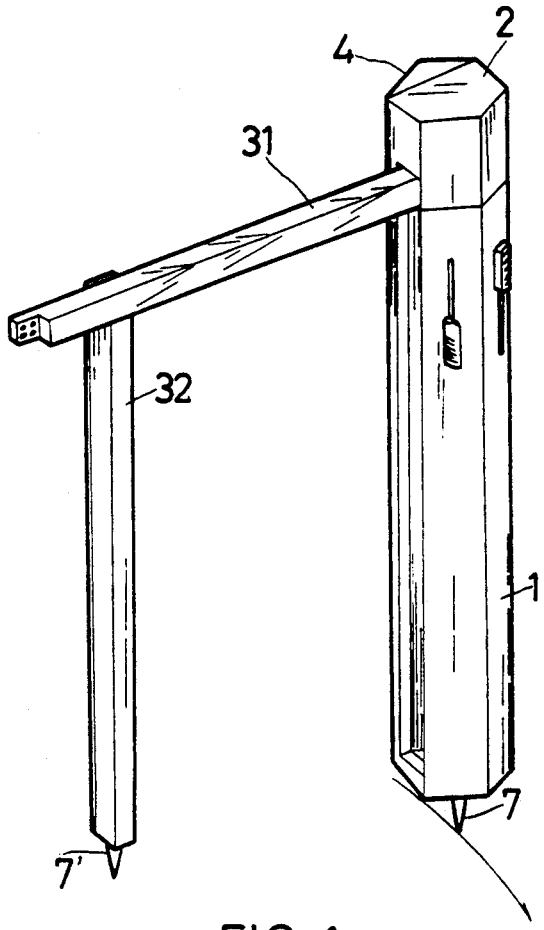
FIG. 1 is an elevational view of the preferred embodiment of the combination tool assembly of the present invention arranged in the form of a compass for drawing circles.
Figure 2:
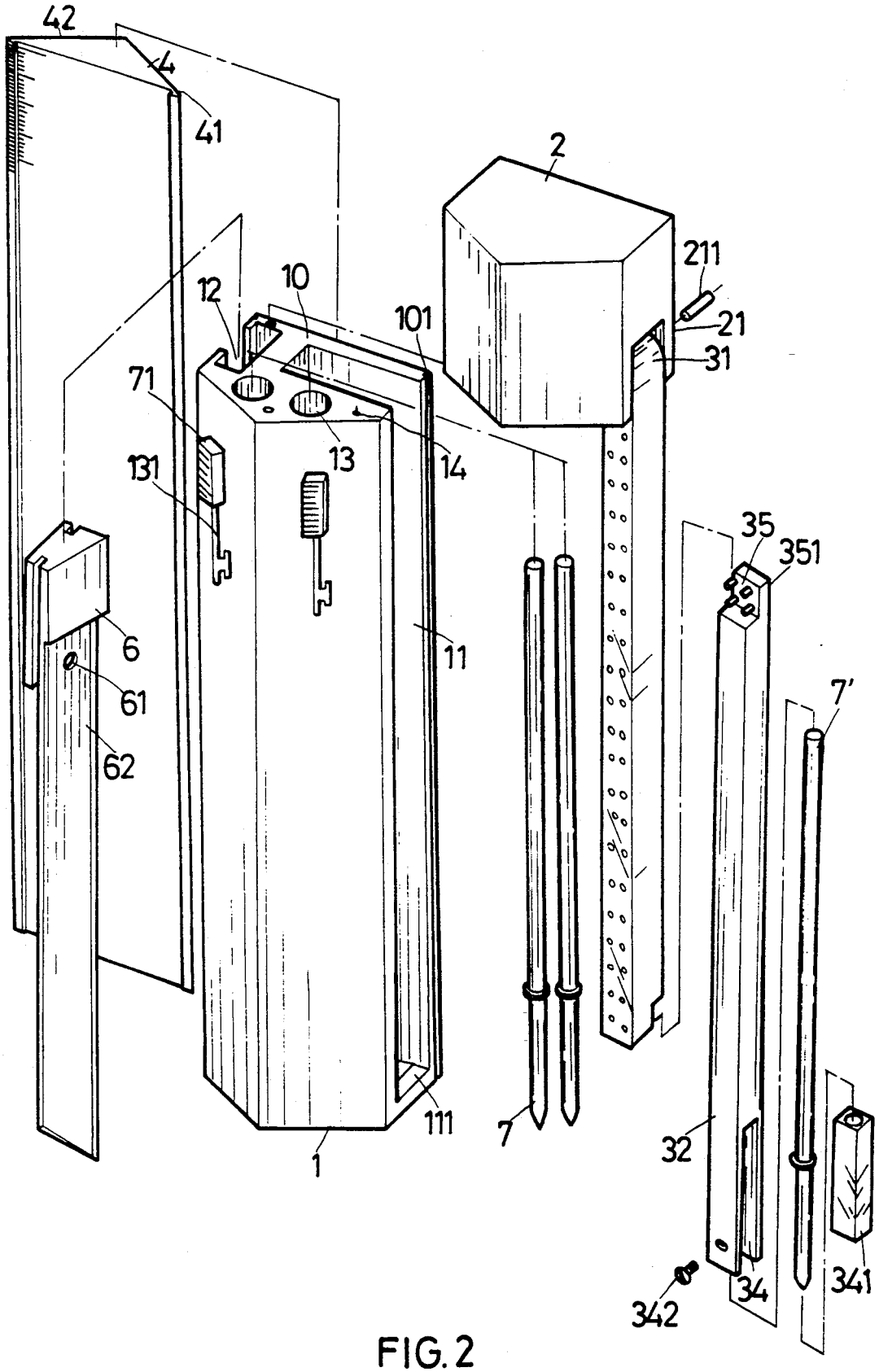
FIG. 2 is an exploded view thereof.

Referring to FIGS. 1 and 2, the present invention is generally comprised of a base 1, a top block 2, a folding rule 3, and a triangular scale 4. The base 1 is made in the shape of a pentagonal prism with vertical tangent plane 10 on one side, having a rule chamber 11, a cutter chamber 12, and pen holes 13 respectively disposed in longitudinal direction. The rule chamber 11 is an elongated space longitudinally extended upwards through the top of the base 1 and downwards to a suitable depth, having an outward slope 111 at the bottom. Through the outward slope 111, the folding rule 3 can be conveniently drawn out of the rule chamber 11 or folded up and received inside the rule chamber 11. The cutter chamber 12 is an elongated through hole through the length of the base 1, into which a sliding block 6 fits. A cutter blade 62 is fastened to a peg 61 on the sliding block 6 and drawn to slide in and out of the cutter chamber 12. Two refills 7 are respectively inserted in the pen holes 13 and carried by a respective slide 71. The slide 71 is moved along a respective sliding slot 131 to extend the respective refill 7 out of the respective pen hole 13 for writing or receive it back inside the respective pen hole 13. The base 1 has dowel holes 14 on the top for fastening the top block 2. The top block 2 is made in the shape of a pentagonal block fitted over the base 1 at the top, having a plurality of bottom dowels 22 respectively fitted into the dowel holes 14 on the base 1, and a bottom opening 21 fitted over the rule chamber 11 at the top to hold the folding rule 3 by a pivot pin 211. The folding rule 3 is consisted of a first rule section 31 and a second rule section 32. The first rule secliun 31 has one end pivotally fastened to bottom opening 21 of the top block 2 by the pivot pin 211, and an opposite end pivotally connected to one end of the second rule section 32.

The second rule section 32 has a hole 34 on the bottom, which receives a refill 7'. A movable block 341 is adjustably fastened in the hole 34 by a tightening up screw 342 to hold the refill 7', for permitting the refill 7' to be extended out of the hole 34 for use in writing or received back inside the hole 34. The top of second rule section 32 further has a recess 35 with pins 351 adjacent to the top end thereof. By detaching the second rule section 32 from the swivel coupler 33 and fastening the pins 351 to holes 311 on the first rule section 31, the second rule section 32 is fastened to the first rule section 31 at right angles in parallel with the base 1 for drawing circles. The triangular scale 4 is as long as the total length of the base 1 and the top block 2, having two opposite, longitudinal channels 41 on one side thereof throughout its length, which receive two opposite, flat, longitudinal, outward flanges 101 of the top block 2 and the vertical tangent plane 10 of the base 1. Therefore, the triangular block 4 can be conveniently and detachably fastened to the base 1.

Figure 3:
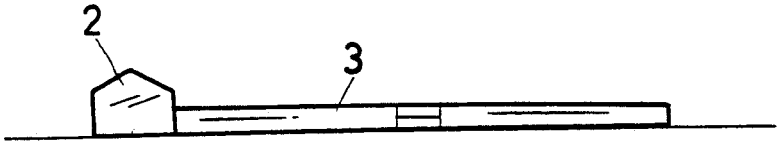
FIG. 3 illustrates the folding rule and the top block are detached from the base for independent use.

Referring to FIG. 3, the top block 2 may be detached from the base 1 so that it can be used with the folding rule 3 for measuring lengths.

Figure 4:
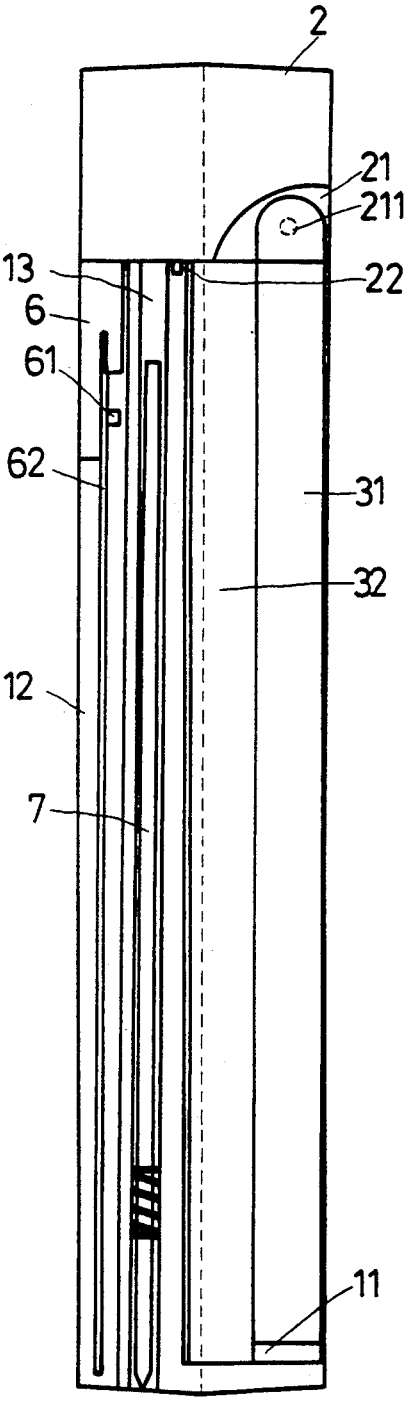
FIG. 4 is a sectional plain view in longitudinal direction showing the cutter, refills and folding rule received inside the base.
Figure 5:
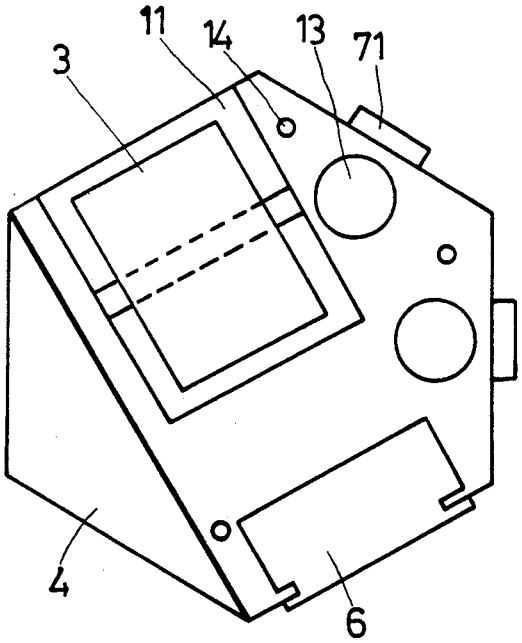
FIG. 5 is a top plain view of the combination tool assembly.

Referring to FIG. 4 and seeing FIGS. 1 and 2 again, the triangular scale 4 may be detached from the base 1 and separately used for angle measure through the graduations on one angle 42 thereof; the cutter blade 62 may be moved out of the base 1 for cutting things; the folding rule 3 may be arranged with the top block 2 and the base 1 into an instrument for drawing circles.

What is claimed is:

1. A combination tool assembly for graphic art comprising:

a base made in the shape of a pentagonal prism with a vertical tangent plane on one side thereof, having a rule chamber, a cutter chamber, and pen holes respectively disposed in parallel with said vertical tangent plane and dowel holes on a flat, top surface thereof, said rule chamber being an elongated space laterally and upwardly extended to the outside;

a top block fitting over said base at the top, said top block having bottom dowels respectively and detachably fitted into said dowel holes on said base and a bottom opening fitting over said rule chamber at the top;

a folding rule consisted of a plurality of straight rule sections hinged to one another, said folding rule having one end pivoted to said top block within said bottom opening so that the folding rule can be folded up and received inside said rule chamber;

a triangular scale being as long as the total length of said base and said top block, and having two opposite, longitudinal channels on one side thereof throughout its length, which receive two opposite, flat, longitudinal, outward flanges of said top block and said vertical tangent plane of said base, said triangular scale being detachably attached to said top block and said base at one side in longitudinal direction and incorporated therewith into the form of a hexagonal prism;

a cutter device fastened inside said cutter chamber and controlled by a slide to move in and out of said base; and ballpoint pens respectively fastened inside said pen holes on said base and controlled by a respective slide to move in and out of said base.

2. The combination tool assembly of claim 1 wherein said folding rule includes at least a first straight rule section pivoted to said top block, and a detachable last straight rule section, said first straight rule section having series of pin holes on one side in longitudinal direction, said detachable last straight rule section having a hole on a bottom end thereof, a ballpoint pen received inside the hole and controlled to move out of the hole for writing, and a recess with pins on one side adjacent to a top end thereof, the tool assembly being used as an instrument for drawing circles by fastening the pins on said last straight rule section into respective holes on said first straight rule section for permitting said last straight rule section to be disposed in parallel with with said base.

3. The combination tool assembly of claim 1 wherein said triangular scale has graduations on angles thereof, and can be used as a proportional scale as well as an instrument for angle measure.

* * * * *